US006195899B1

(12) United States Patent
Watanabe

(10) Patent No.: US 6,195,899 B1
(45) **Date of Patent: *Mar. 6, 2001**

(54) KNIFE

(75) Inventor: Hideyo Watanabe, Niigata (JP)

(73) Assignee: Yoshida Metal Industry Co., Ltd., Niigata (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,677

(22) Filed: Dec. 29, 1998

(51) Int. Cl.[7] ..... B25G 1/00
(52) U.S. Cl. ..... 30/340; 342/344
(58) Field of Search ..... 30/340, 125, 344, 30/342; D22/118; D7/649; 81/489, 177.1; 16/430, 436, 421, DIG. 12

(56) References Cited

U.S. PATENT DOCUMENTS 209,649 * 11/1878 Brown et al. ..... 30/340
4,147,918 * 4/1979 Ritter et al. ..... 30/340 X
4,389,777 * 6/1983 Landsberger ..... 30/340 X
4,470,327 * 9/1984 Gerber, Jr. et al. ..... 30/344 X
5,042,804 * 8/1991 Uke et al. ..... 473/538
5,689,890 * 11/1997 Glesser ..... 30/340

FOREIGN PATENT DOCUMENTS 0523713 1/1993 (EP) .
1509310 5/1978 (GB) .

* cited by examiner

*Primary Examiner*—M. Rachuba
(74) *Attorney, Agent, or Firm*—Birch, Stewart, Kolasch & Birch, LLP

(57) ABSTRACT

A knife having a blade made of stainless steel and a hollow handle made of stainless steel. The hollow handle has right and left handle halves which are butt-joined to each other at their joining faces. The handle halves define therebetween a hollow portion which is filled with a filler, which may be river sand, for adjustment of the overall weight balance of the knife. The blade and the handle are butt-joined into one piece at their confronting end edges.

9 Claims, 4 Drawing Sheets

KNIFE

BACKGROUND OF THE INVENTION

1. Technical Field

The present invention relates to a knife, and more particularly, to a knife which is especially suitable for professional use and which has improved durability and ease-of-use features.

2. Related Art

A knife for domestic or professional use, such as utility knife or chef's knife, is typically comprised of a blade, a tang formed integrally with the blade and extending backward therefrom, and a wooden handle having handle halves riveted on opposite side faces of the tang. The wooden handle is poor in durability and permits the breeding of harmful bacterium to tend to impair the cleanliness of the knife.

The overall weight balance of a knife, especially in the case of a knife for professional use which is ordinarily used for many hours, greatly affects the degree of fatigue of a user, and also affects the sharpness or ease-of-cutting ability of the knife. A conventional knife having the aforementioned construction is poor in the degree of freedom in adjusting the balance of weight, and makes it difficult to attain an optimum weight balance.

SUMMARY OF THE INVENTION

An object of the present invention is to provide a knife which is excellent in durability and ease of use.

Another object of the present invention is to provide a knife which is excellent in overall weight balance.

A knife according to the present invention comprises a metal blade having an end edge, and a metal handle having an end edge confronting the blade. The handle is formed with a hollow portion for adjustment of weight distribution mainly in a lengthwise direction of the handle. The handle is made of a metallic material of a kind which is the same or different from a metallic material for the blade. The blade and the handle are butt-joined at their endedges intoonepiece. Preferably, the blade and the handle are butt-welded at their end edges.

According to the knife having the metal blade and the hollow metal handle which are formed into one piece, the handle is not decayed and does not permit the breeding of bacterium unlike the case of a conventional knife having a wooden handle. Thus, the knife according to the present invention has improved durability and cleanliness. The weight distribution mainly in the lengthwise direction of the handle is made proper by forming the hollow portion of the handle to have an appropriate volume, whereby a suitable overall weight balance of the knife can be attained. Further, this invention is advantageous in that the recycling of knives can be easily made.

Preferably, the blade is made of stainless steel, e.g., hard stainless steel. More preferably, the blade is made of stainless steel to which molybdenum and vanadium are added. The handle is made of stainless steel of a kind which is the same as or different from the stainless steel of which the blade is made.

According to this preferred construction, the blade is excellent in toughness and hardness and is permitted to be appropriately formed with a sharpened blade edge. Further, the handle and the blade are permitted to be properly welded together, and are prevented from being rusted.

Preferably, the handle has side faces thereof each formed with a nonskid structure comprised of an array of dents.

With this preferred construction, the knife is prevented from slipping in the user's hand, so that the knife is easy to use.

Preferably, the handle is comprised of two handle halves which are butt-joined at their joining faces. These handle halves define therebetween the hollow portion of the handle. Preferably, the handle halves are but-welded at their joining faces.

With this preferred construction, the weight distribution mainly in the lengthwise direction of the handle is optimized by using the handle halves obtained from a metal plate having an appropriate thickness, whereby the handle having an optimum weight distribution can be relatively easily obtained, and the overall weight balance of the knife can be optimized.

Preferably, the knife further comprises weight balancing means provided in the hollow portion of the handle. More preferably, the weight balancing means includes a filler filled within the hollow portion of the handle. The filler is preferably filled tightly in the hollow portion. The filler is comprised of river sand or a mixture of river sand and cement or steel spheres.

With this preferred arrangement, the overall weight balance of the knife can be optimized, so that the degree of fatigue of the user using the knife for many hours can be reduced, and the ease-of-cutting ability of the knife can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

Figure 1:
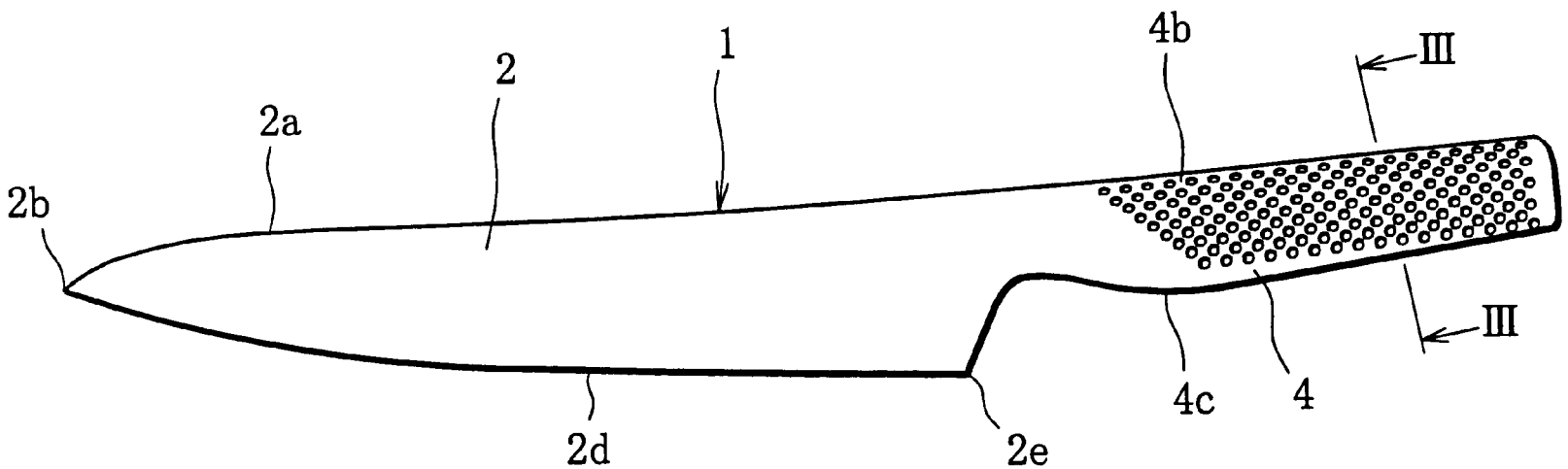
FIG. 1 is a side view showing a knife according to an embodiment of the present invention.

As shown in FIG. 1, a knife 1 according to an embodiment of the present invention, which is especially suited for professional use, comprises a metal blade 2 and a metal handle 4 which is butt-joined to the blade 2.

The handle 4 has a hollow portion in which a filler 6 for adjustment of the overall weight balance of the knife is tightly filled. The filler 6 is comprised of river sand or a mixture of river sand and cement or steel spheres. The volume of the hollow portion is determined such that a proper weight-balance adjustment is achieved in cooperation with the weight-balancing function of the filler.

The knife blade 2 is made of a metallic material which has adequate toughness and hardness and which permits the blade to be formed with a blade edge. For example, the blade 2 is made of stainless steel, preferably, ultra-hard stainless steel containing molybdenum and vanadium. The ultra-hard stainless steel of this kind is used as a material, e.g., for surgical knife. In this embodiment, the handle 4 is made of a metallic material, such as ultra-hard stainless steel which is the same kind as that for the blade 2. Alternatively, the handle 4 may be made of a material of a kind different from that for the blade 2 so long as the handle 4 is permitted to be properly welded to the blade 2.

The blade 2, which is solid, has an upper face, i.e., a back 2*a*, extending from a distal end (tip point) 2*b* of the knife to an upper end of a rear end edge 2*c* of the blade 2. The back 2*a* is slightly curved at its distal end portion and extends substantially straight in parallel to the longitudinal axis of the knife at the intermediate and rear end portions of the back 2*a*.

The blade 2 has a blade edge 2*d* thereof extending, with a slight curvature, from the tip point 2*b* and terminating at a heel 2*e*. A remaining lower edge of the blade 2 extends from the heel 2*c* to a lower end of the rear end edge 2*c* with a steep curvature.

Figure 2:
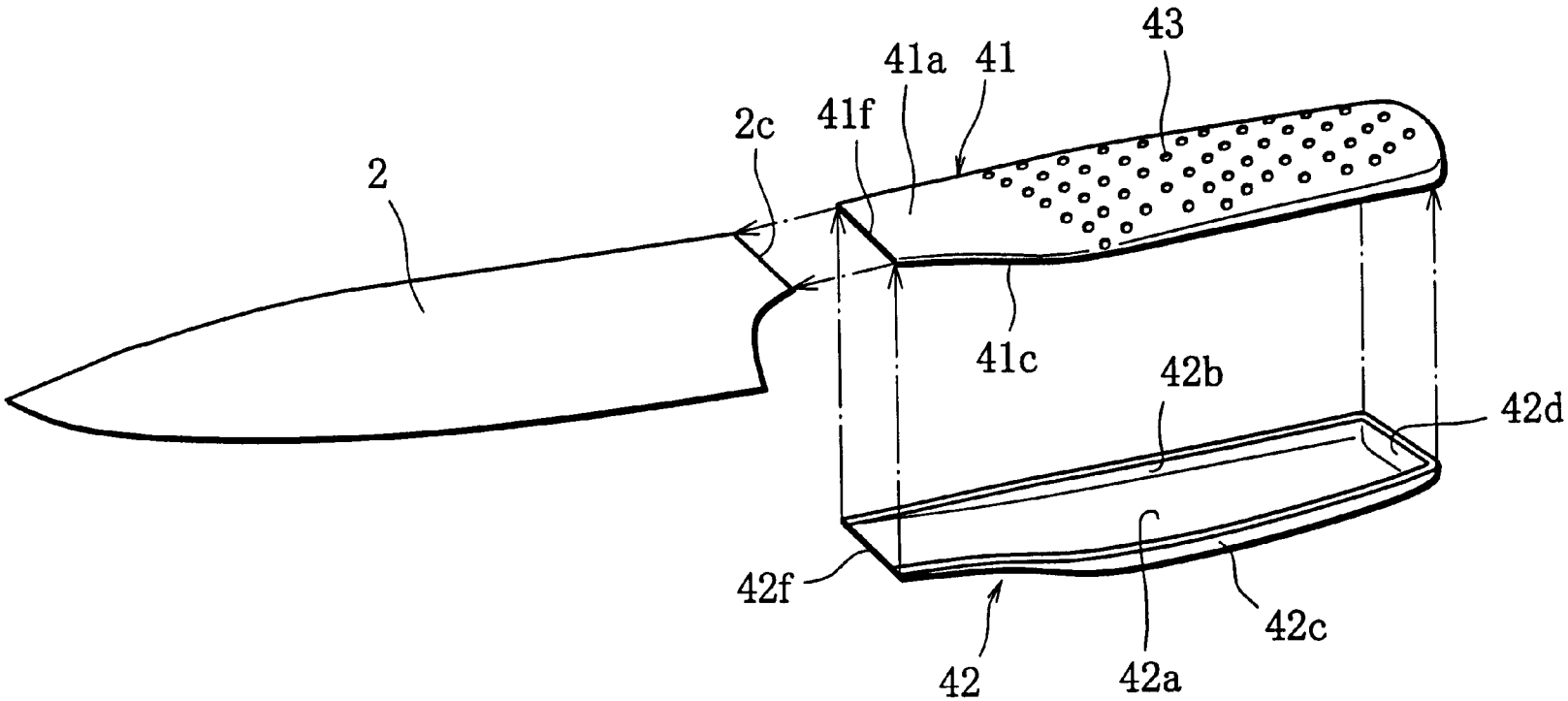
FIG. 2 is an exploded perspective view of the knife shown in FIG. 1.

The handle 4 is comprised of right and left handle halves 41 and 42 which are joined to each other. Preferably, these handle halves have their shapes which are symmetrical with respect to their joining faces. Each handle half is obtained by forming a metal plate into a dish shape. The metal plate in this embodiment has a thickness which is about one-half of that of the blade 2. Each handle half 41 or 42 has a side wall 41*a* or 42*a* corresponding to the left wall or the right wall of the handle 4. Each of the side walls 41*a* and 42*a* is formed with a number of small semispherical dents (only those formed in the left handle half 41 are shown by reference numeral 43 in FIG. 2) at spatial intervals in an area extending from its intermediate portion to its rear end. The array of the dents 43 constitutes a nonskid structure for preventing the knife from slipping in the user's hand.

Figure 3:
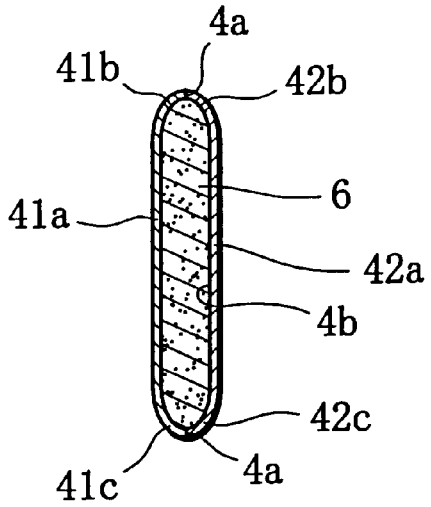
FIG. 3 is a transverse sectional view of the knife handle taken along III—III line of FIG. 1.

Each handle half has an upper wall 41*b* or 42*b*, a lower wall 41*c* or 42*c*, and a rear wall (the rear wall of the handle half 42 is indicated by reference numeral 42*d*) formed integrally with the side walls. The upper and lower walls are smoothly connected with the side wall, as best shown in FIG. 3. The widthwise dimension of each of upper and lower walls is equal to, e.g., zero at a front end edge 41*f* or 42*f* of the handle half, so that the below-mentioned hollow portion is not present at the front end edge of the handle.

The right and left handle halves 41, 42 are butt-joined to each other at their joining faces 4*a*, and cooperate to each other to define a hollow portion 4*b* of the handle 4 therebetween. As explained above, the hollow portion 4*b* has an appropriate volume and is filled with a filler 6 for weight-balance adjustment.

The handle 4 comprised of the handle halves 41, 42 is butt-joined at its front end edge 41*f*, 42*f* to the rear end edge 2*c* of the blade 2. The front end edge 41*f*, 42*f* has its length which is the same as that of the rear end edge 2*c*. The handle 4 has an upper edge 4*b* thereof extending substantially parallel to the longitudinal axis of the knife. At a distal end portion of the handle 4, i.e., at an intermediate portion of the knife, a lower edge 4*c* of the handle 4 extends, with a curvature, obliquely with respect to the longitudinal axis of the knife so that the height of the handle 4 becomes larger toward a rear end of the handle. On the other hand, in an area from an intermediate portion to a rear end portion of the handle 4, the lower edge 4*c* of the handle extends substantially straight and obliquely with respect to the longitudinal axis of the knife so that the height of the handle 4 becomes slightly smaller toward the rear end of the handle.

The handle 4 has outer and transverse sectional shapes permitting the handle to be adequately fitted to the user's hand. This ease-of-grasp feature cooperates with the aforementioned array of the semi-spherical dents 43 to provide a nonskid feature.

Figure 4:
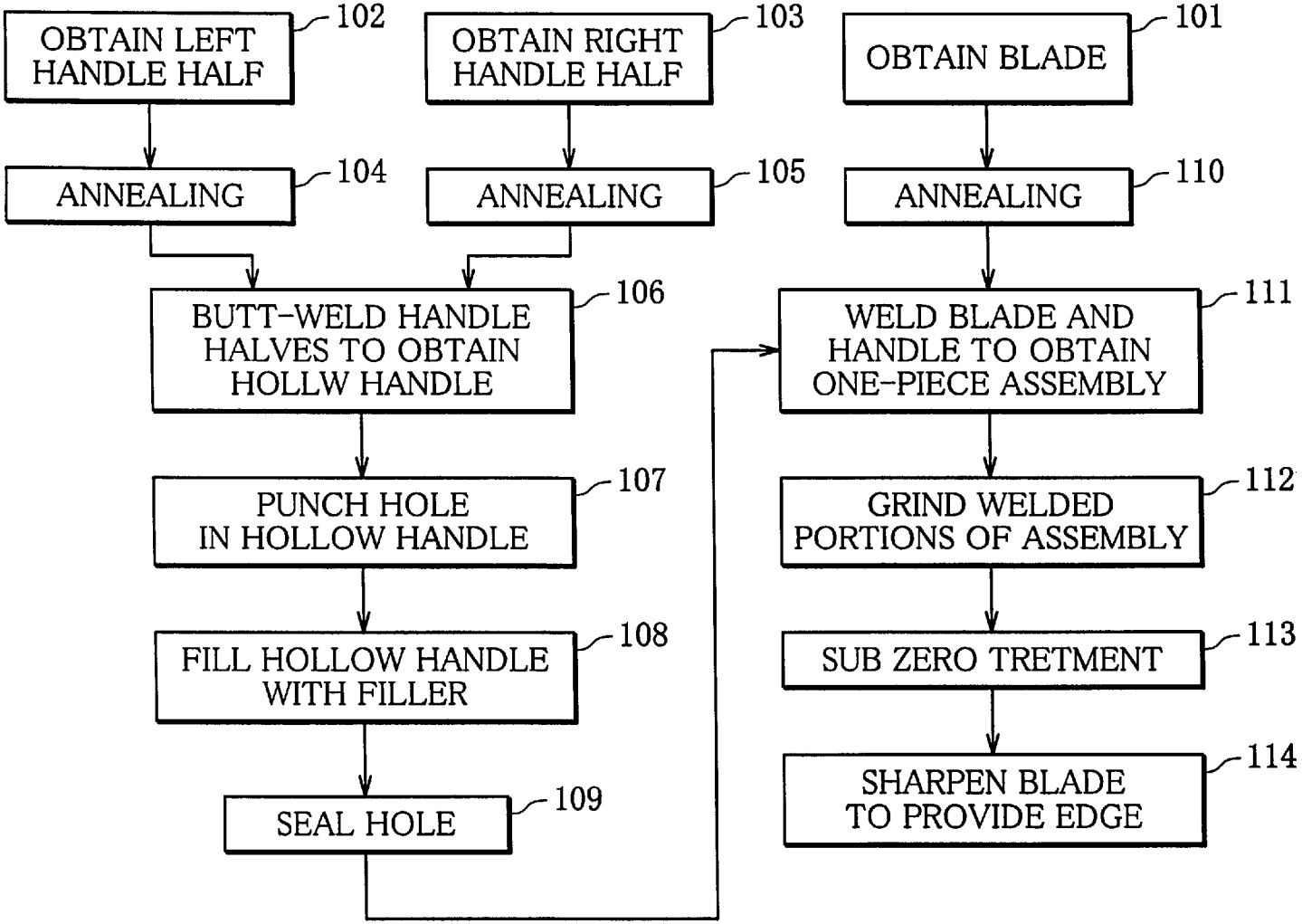
FIG. 4 is a diagram showing manufacturing processes of the knife shown in FIG. 1.

With reference to FIG. 4, processes of manufacturing the knife 1 having the aforementioned construction will be explained.

First, hard stainless steel plates are subject to hot forging, for instance, to thereby obtain a blade 2 and right and left handle halves 41, 42 (processes 101, 102 and 103 shown in FIG. 4). Next, the handle halves 41 and 42 are subject to annealing, respectively (processes 104 and 105). Then, the handle halves 41 and 42 are clamped by a clamp mechanism (not shown) in a state where they are abutted against each other at their joining faces 4*a*, and are butt-joined into one piece by means of argon arc welding (process 106), to thereby obtain a hollow handle 4. Next, the handle 4 is subject to punching so that the handle is formed at its rear wall with a through hole, not shown (process 107). A filler 6, e.g., river sand, is tightly filled, through the through hole, in a hollow portion 4*b* of the handle (process 108), as exemplarily shown in FIG. 3. After the filler 6 is filled, the through hole of the rear wall of the handle 4 is sealed (process 109), whereby the handle filled with the filler 6 is obtained.

On the other hand, the blade 2 obtained in process 101 is subject to annealing (process 110). By means of argon arc welding, for instance, the annealed blade is butt-joined to the handle filled with the filler (process 111), whereby a one-piece blade/handle assembly is obtained. The assembly is subject to grinding to remove excess materials and provide smooth finish around the welded portions (2*c*, 41*f*, 42*f*, 4*a*) at which the blade and the handle are welded and the handle halves are welded together (process 112). Further, the blade/handle assembly is subject, in its entirety or at its blade edge, to sub zero treatment (process 113). The sub zero treatment can be made in various manners. For instance, low temperature medium such as liquid nitrogen is directly sprayed to the blade edge to cool the same. Alternatively, the assembly is placed in a cooling pool after the ambient atmosphere in the cooling pool is cooled. Finally, the blade is sharpened to provide a blade edge 2*d* (process 114), to thereby obtain a knife 1.

The knife according to the present invention is not limited to the foregoing embodiment but may be modified variously.

For instance, a hollow handle may be obtained by bending a single metal sheet into a U-shape and by welding adjacent edges of the U-shaped sheet together, although the handle is obtained in the embodiment by butt-joining handle halves into one piece.

One or more metal balancers serving as weight balancing means may be welded or mounted to an inner surface of the side wall of each handle half, although the weight balancing means in the embodiment is comprised of a filler filled in the hollow portion of the handle.

The processes of manufacturing the knife of this invention are not limited to those shown in FIG. 4. For instance, it is not inevitably necessary to subject the knife to sub zero treatment.

Figure 5:
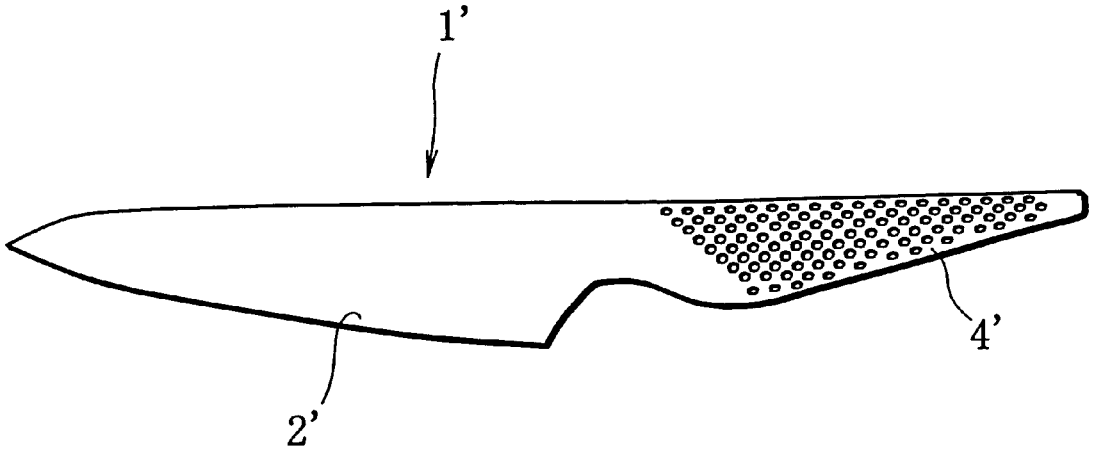
FIG. 5 is a side view showing a knife according to a modification of the present invention.

The outer and sectional shapes of the knife blade and the knife handle are not limited to those of the embodiment, but may be modified variously in accordance with, e.g., the purpose for which the knife is used. FIG. 5 shows a small knife 1' according to a modification of this invention. The knife 1' has a blade 2' and a handle 4' whose outer shapes and dimensions are different from those of the knife 1 of the embodiment. The handle 4' has its lower edge extending obliquely to form a considerable angle between itself and the longitudinal axis of the knife 1', so that the height of the handle 4' becomes considerably smaller toward the rear end of the handle.

In the embodiment, an explanation has been given by taking, as an example, the knife 1 especially suitable for professional use. However, the present invention is also applicable to knives suited to household use, butcher-shop use or the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A knife comprising:

a metal blade having an end edge;

a metal handle having an end edge confronting the blade, said handle being formed with a hollow portion for adjustment of weight distribution mainly in a lengthwise direction of the handle, said handle being made of a metallic material of a kind which is the same or different from a metallic material for the blade, said blade and said handle being butt-joined at their end edges into one piece, said handle having said faces thereof each formed with a nonskid structure including an array of semispherical dents; and weight balancing means provided in said hollow portion of said handle.

2. The knife according to claim 1, wherein said blade is made of stainless steel, and said handle is made of stainless steel of a kind which is the same as or different from the stainless steel of which said blade is made.

3. The knife according to claim 1, wherein said handle includes two handle halves which are butt-joined at their joining faces, said handle halves defining therebetween said hollow portion of said handle.

4. The knife according to claim 1, wherein said weight balancing means includes a filler filled within said hollow portion of said handle.

5. The knife according to claim 4, wherein said filler includes river sand.

6. A knife comprising:

a blade formed from a stainless steel plate material and having an end edge:

a handle having an end edge facing the blade, and side faces, said blade and said handle being butt-joined at their end edges into one piece, said handle including two handle halves each formed from a stainless steel plate material of a kind which is the same as or different from that of the stainless steel plate material from which said blade is made, said handle halves being butt-joined at their joining faces and defining therebetween a hollow portion;

weight balancing means for adjusting weight distribution mainly in a lengthwise direction of said handle, said weight balancing means including a filler which includes river sand or a mixture of river sand and cement or steel spheres and which is tightly filled within said hollow portion of said handle; and a nonskid structure comprised of an array of dents, said array of dents including a number of semispherical dents formed in each of said side faces of said handle, wherein stainless steel plate material used to form said handle halves has a thickness that optimizes the weight distribution of said knife in cooperation with said weight balancing means, and said handle has an outer profile that permits the handle to be fitted to a hand of a user.

7. The knife according to claim 6, wherein:

said blade has a back portion extending from a tip point of said knife to an upper end of a rear end edge, corresponding to said end edge, of the blade, said back being curved at its distal end portion and extending substantially straight in parallel to a longitudinal axis of said knife at intermediate and rear end portions of the back; and said blade has a blade edge extending, with a curvature, from the tip point and terminating at a heel, a remaining lower edge of the blade extending from the heel to a lower end of the rear end edge with a curvature.

8. The knife according to claim 7, wherein:

said handle has an upper edge extending substantially parallel to the longitudinal axis of the knife;

said handle has a curved lower edge wherein a height of the handle becomes larger from the blade toward an intermediate portion of the handle; and the lower edge of the handle extends from an intermediate portion to a rear end portion of the handle substantially straight and obliquely with respect to the longitudinal axis of the knife, the height of the handle decreasing from the intermediate portion of the handle toward the rear end of the handle.

9. The knife according to claim 7, wherein:

said handle has an upper edge extending substantially parallel to the longitudinal axis of the knife;

said handle has a curved lower edge that extends obliquely with respect to the longitudinal axis of the knife from an intermediate portion of the knife towards a rear end of the handle so that a height of the handle becomes larger toward an intermediate portion of the handle; and the lower edge of the handle extends obliquely from the intermediate portion of the handle to form an angle between itself and the longitudinal axis of the knife the height of the handle becoming substantially smaller from the intermediate portion of the handle toward the rear end of the handle.

* * * * *